United States Patent [19]

Swift

[11] Patent Number: 4,836,590

[45] Date of Patent: Jun. 6, 1989

[54] SECURITY SEAL WITH TAMPERING INDICATOR

[75] Inventor: Allan W. Swift, Denville, N.J.

[73] Assignee: E. J. Brooks Company, Newark, N.J.

[21] Appl. No.: 186,572

[22] Filed: Apr. 27, 1988

[51] Int. Cl.[4] ..... B65D 33/34

[52] U.S. Cl. ..... 292/320

[58] Field of Search ..... 292/307 A, 307 B, 307 R, 292/318, 319, 320, 321, 322; 24/16 PB; 70/20

[56] References Cited

U.S. PATENT DOCUMENTS

| | | | |
|---|---|---|---|
| 894,278 | 7/1908 | Murray | 292/320 |
| 906,052 | 12/1908 | Murray | 292/320 |
| 1,054,440 | 2/1913 | Murray | 292/320 |
| 1,964,015 | 6/1934 | Wenk | 292/320 |
| 2,020,198 | 11/1935 | Miller | 292/320 |
| 4,146,258 | 3/1979 | Andruchlw | 292/256.6 |
| 4,254,977 | 3/1981 | Guiler | 292/320 |
| 4,733,893 | 3/1988 | Davis et al. | 292/320 |

*Primary Examiner*—Gary L. Smith
*Assistant Examiner*—Eric K. Nicholson
*Attorney, Agent, or Firm*—John G. Gilfillan, III

[57] ABSTRACT

A padlock-type security seal including a U-shaped shackle, a pair of reversely bent end portions, and a transparent body portion having a pair of chambers for receiving the bent end portions. The chambers each have a locking groove therein for receiving the bent end portions. A frangible tab is mounted adjacent one of the locking grooves. Attempts to pick the seal by deforming the shackle will result in breaking the tab. The tab, after breaking, will protrude into the chamber where it can be viewed through the transparent body to indicated tampering.

5 Claims, 2 Drawing Sheets

SECURITY SEAL WITH TAMPERING INDICATOR

BACKGROUND OF THE INVENTION

The present invention relates to a security seal of the padlock type and, more particularly, to a security seal having a tampering indicator.

Security seals of the padlock type are generally well known, and have found wide spread use for sealing structures such as currency bags, closures, electric meters, and the like. Examples of such seals may be found in the following U.S. Pat. Nos. 3,375,033; 3,980,332; 4,353,583; 4,278,281; and 4,687,240.

All of these seals have, generally, a plastic body with a pair of spaced cavities in which a U-shaped shackle is permanently locked. Locking the shackle is typically accomplished by a pair of reversely bent, resilient legs that register with a bump or notch located in the spaced cavities. Although such devices have served the purpose, they have not proved entirely satisfactory, because some efforts to defeat such structures have proved successful.

In some case it is possible to remove the shackle portion by deforming the shackle and forcing it from the cavities, and thereafter reshape the shackle and reinsert it in the cavities without any apparent evidence that the seal had been opened. Prior art attempts to improve such seals have included various means to indicate tampering under such circumstances. For example, in U.S. Pat. No. 4,687,240 there is disclosed a seal having a pigmental polypropylene body which will produce a highly visible white blush when deformed by a shackle as it is forced from the seal body. The '240 seal also has a second tamper indicating feature. The exterior of the seal body has a slot into which the shackle ends will protrude if forced sufficiently to penetrate the relatively soft polypropylene seal body. Although such seals have served the purpose, they have not proved satisfactory under all circumstances.

It has been found that polypropylene is not stable when exposed to ultraviolet light for substantial periods. Therefore, after many years of use on electric meters exposed to sunlight, polypropylene seals have broken down, leaving the seals vulnerable to tampering. For example, the body of such seals have been known to loose their pliability, cease blushing when deformed, crack, etc., as a result of ultraviolet exposure for prolonged periods.

Therefore, those concerned with the development of such seals for long term use have turned to other materials that are stable in ultraviolet environments. One popular replacement material is acrylic, an inexpensive thermoplastic that is normally colorless. However, because acrylic does not blush, and is not sufficiently soft and pliable, many of the tamper indicating features of polypropylene seals are not possible in acrylic seals. Hence, those skilled in these arts have turned to other tamper indicating structures more suitable for seals made of materials such as acrylic. For example, the above-cited U.S. Pat. No. 3,980,332 shows a seal which includes a tampering indicator in the form of an insert that is used to lock the shackle, but the insert is made frangible and will normally break easily when attempts are made to separate the shackle from the seal body. Many seals of this type, however, may still be vulnerable to some forms of undetected tampering. Some seals with frangible inserts can be compromised by properly supporting the frangible insert while pulling on the shackle. As a result the deformed shackle can be removed from the body without breaking the frangible insert. Therefore, efforts to improve such seals have had only limited success.

SUMMARY OF THE INVENTION

It is, therefore, an object of the invention to provide an improved tamper resistant security seal.

In accordance with the present invention, there is provided a padlock-type security seal including a U-shaped shackle having a pair of reversely bent end portions and a body portion having a pair of chambers for receiving the bent end portions. The chambers each have a locking groove therein for receiving the bent end portions. A frangible tampering indicator, formed as an integral part of the seal, is located adjacent one of the grooves. Attempts to open the present seal by deforming the shackle to remove the bent end portions from the chambers will result in breaking the frangible indicator, thereby indicating tampering.

The exact nature of this invention, as well as other objects and advantages thereof, will be readily apparent from consideration of the following specification relating to the annexed drawings in which:

DETAILED DESCRIPTION OF THE PREFERRED EMBODIMENT

Figure 1:
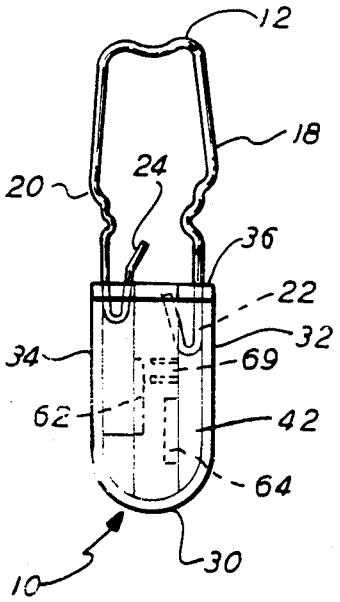
FIGS. 1–3 are plan views of the preferred embodiment.

Referring now to the drawings, there is shown a security seal 10 having a resilient shackle 12, a seal body 14, and an insert 16. The resilient shackle 12, formed of spring wire, is generally U-shaped with a long leg 18 and a short leg 20. Legs 18 and 20 have reversely bent end portions 22 and 24, respectively. Legs 18 and 20 are also formed with anti-picking bumps 26 and 28, respectively.

The seal body 14 is made of molded transparent plastic, preferably acrylic, that forms a flat, generally rectangular box having a narrow curved bottom wall 30, two parallel narrow side walls 32 and 34, and a narrow top wall 36 with an opening 38 therein. The narrow walls 30, 32. 34 and 36 are joined by broad side walls 40 and 42 to define a narrow hollow interior. The hollow interior consists of parallel side channels 46 and 48 of equal thickness joined by a thicker central channel 50.

Insert 16, also made of molded plastic, has a brightly colored elongated body 60 with overall dimensions substantially equal to the dimensions of channel 50. A groove 62 is formed in one side of insert 16, and a groove 64 is formed in the opposite side of the insert 16. A groove 66 is formed in the side of insert 16 containing groove 64. A groove 67 is located between grooves 64, 66 and opposite groove 62. A frangible tab 69 is formed in groove 67 and is integral with a frangible wall separating grooves 62 and 67. A stop flange 68 is formed on insert 16 between the end groove 62 and the end of insert 16.

Figure 2:
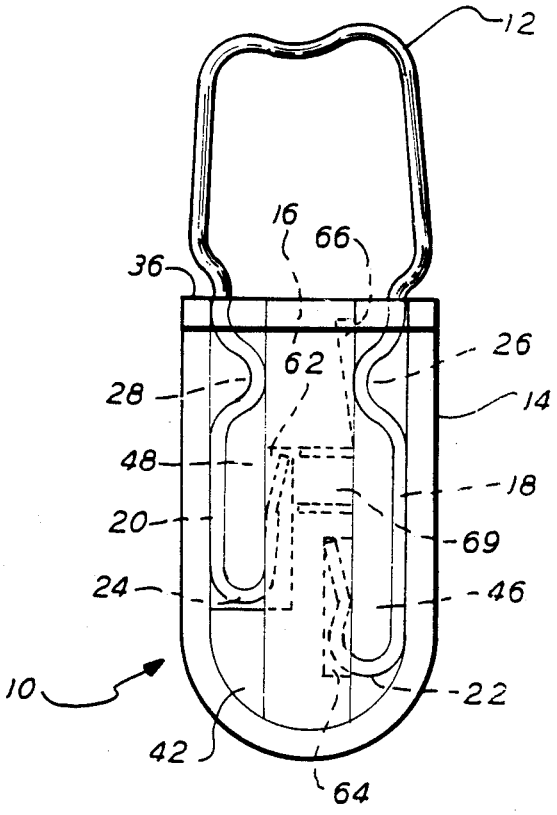

The operation of the seal 10 is as follows. The seal 10 is shipped in the position shown in FIG. 1, i.e., with the reversely bent end portion 22, on long leg 18, inserted in channel 46 and mating with groove 66 to hold the shackle 12 in place. A small portion of the reversely bent end portion 24 on leg 20 is inserted in channel 48. In this position the seal 10 is said to be closed. When it is desired to seal a structure, the seal 10 is opened by removing the short leg 20 from channel 48 and the short leg 20 is threaded through the structure to be sealed. The short leg 20 is then replaced in channel 48 and the seal 10 is locked by pushing the shackle 12 into the channels 46 and 48 until both legs 18 and 20 have their reversely bent end portions 22 and 24 locked in grooves 62 and 64, respectively, as shown in FIG. 2. During this locking operation, the reversely bent end portions 22 and 24 are compressed by the walls of the channels 46 and 48. Such compression does not exceed the elastic limit of the material of the shackle. Thus, when the end portions 22 and 24 are fully inserted, they expand and snap into grooves 62 and 64, respectively.

Figure 3:
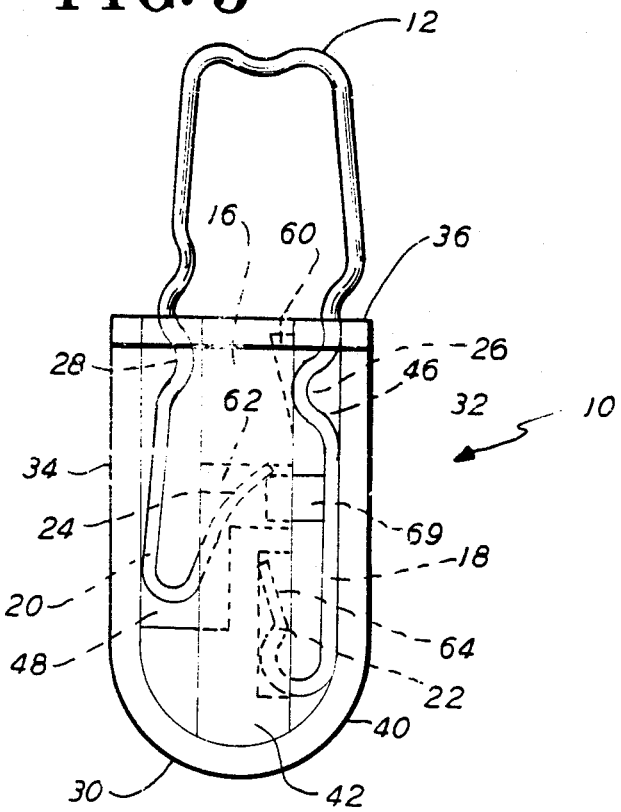
Figure 4:
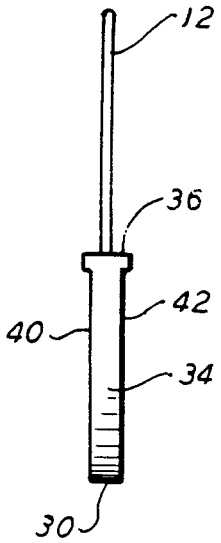
FIG. 4 is a side view of the device shown in FIGS. 1–3.
Figure 6:
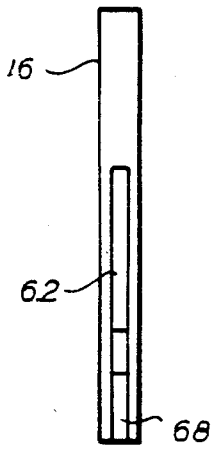
FIGS. 5 and 6 are side views of parts of the preferred embodiment.
Figure 5:
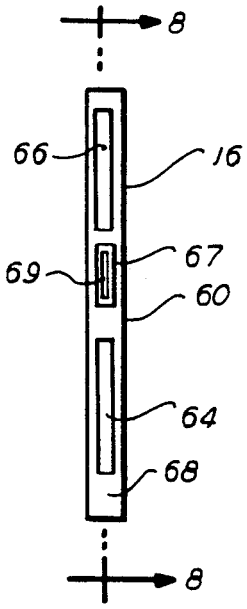
Figure 8:
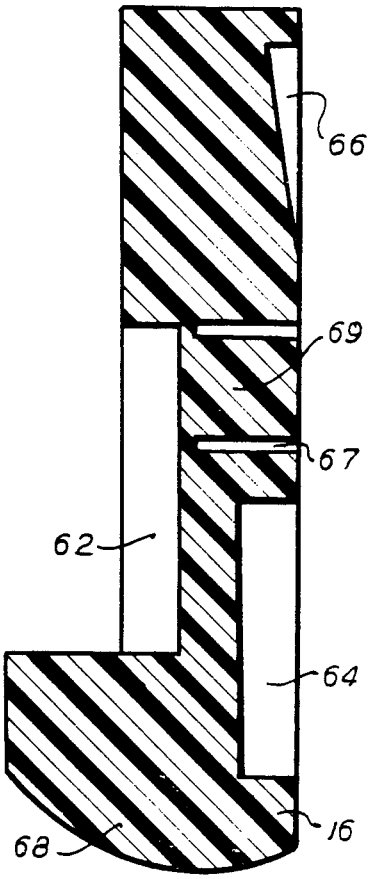
FIG. 8 is a sectional view of the device shown in FIG. 5 taken on the line 8—8 and looking in the direction of the arrows.
Figure 7:
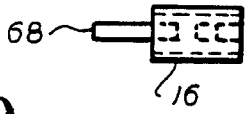
FIG. 7 is a top view of the device shown in FIGS. 5 and 6.
Figure 9:
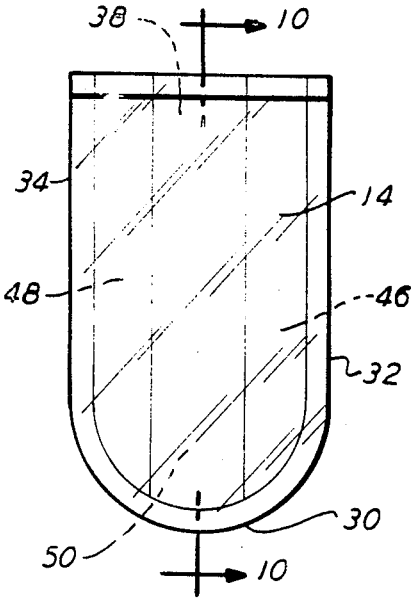
FIG. 9 is a plan elevation view of a portion of the preferred embodiment.
Figure 10:
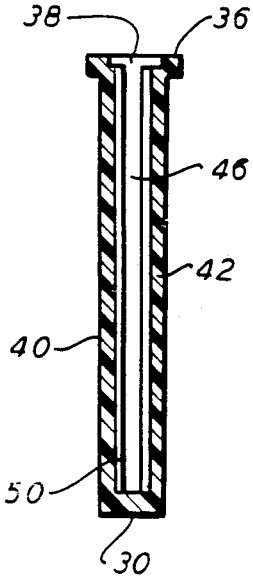
FIG. 10 is sectional view of the device shown in FIG. 9 taken on the line 10—10 and looking in the direction of the arrows.
Figure 11:
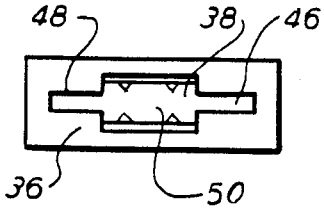
FIG. 11 is a top view of the device shown in FIG. 9.

With reference to FIG. 3, seal 10 is illustrated in a position after tampering. In FIG. 3 the reversely bent end portion 24 on shackle leg 20, which normally presses against tab 69, has been forced further against tab 69 as a result of an attempt to force the shackle from the body 14. Consequently portion 69 has broken the frangible mounting for tab 69, causing it to protrude from groove 67 and to be held there by portion 24. Since the exterior walls of body 14 are transparent the colored tab 69 can be seen from the seal exterior thereby indicating tampering.

The transparent seal body 14 and colored insert 16 may be manufactured inexpensively using standard plastic molding techniques and equipment. As can be seen from the figures, seal body 14 and insert 16 may be made using only positive molds. Thus, seal body 14, formed in the shape of a cup having side walls 32 and 34, a bottom wall 30, and a top opening 38, can be formed conveniently with a positive plastic mold, i.e., the mold elements move only in one linear direction when the mold is opened. Further, the die forming the outside surface of seal body 14 and the plunger forming the inside surfaces of channels 46, 48 and 50, need only be moved in one linear direction to withdraw the plunger from the channels 46, 48, and 50, to withdraw the seal body 14 from the die. The same situation is also possible for the molding of insert 16. The die may be used to form the outside surfaces of the body 60 and flange 68 and the inside of groove 62, while the plunger forms the grooves 64, 67 and 66, and the surface of tab 69. No negative mold elements must be involved.

The insert 16 is formed as a fairly rigid beam-like structure having smooth continuous surfaces thereby making it ideally suited for easy assembly by sliding it through the opening 38 into central channel 50 in seal body 14. The stop flange 68 is dimensioned to snugly slide into channel 48 as the insert 16 is assembled. The insert 16, after insertion, may be conveniently secured in seal body 14 by any standard means; for example, an ultrasonic weld applied to the exterior of seal body 14 in the area adjacent insert 16 can permanently join these parts.

Various modifications are contemplated and may obviously be resorted to by those skilled in the art without departing from the spirit and scope of the invention, as hereinafter defined by the appended claims, as only a preferred embodiment thereof has been disclosed.

What is claimed is:

1. A security seal comprising:

a U-shaped resilient shackle having first and second legs each having a reversely bent end portion;

a hollow seal body having an aperture in one side thereof;

an insert mounted in the hollow interior of said hollow seal body;

said insert and said hollow seal body defining elongated first and second chambers contiguous with said aperture;

said insert having first and second cup-shaped grooves on opposed sides thereof;

each said first and said second groove having opaque walls with an opening therein contiguous with a different one of said elongated chambers; and a tab frangibly mounted in said second groove between the opaque walls thereof and forming a partition frangibly separating said first and second grooves.

2. A security seal according to claim 1 wherein the width of said reversely bent end portions is greater than the width of said chamber plus the depth of said first groove.

3. A security seal according to claim 2 and further including a third groove in said insert on the same side as said second groove.

4. A security seal comprising:

a U-shaped resilient shackle having first and second legs each having a reversely bent end portion;

a transparent hollow seal body having an aperture in one side thereof;

a locking member mounted in the hollow interior of said hollow seal body;

said locking member and said hollow seal body defining elongated first and second chambers contiguous with said aperture;

said locking member having first and second cup-shaped grooves on opposed sides thereof;

each said first and said second groove having opaque walls with an opening contiguous with a different one of said elongated chambers;

a third cup-shaped groove formed in said locking member adjacent said first groove and having opaque walls with an opening contiguous with one of said chambers; and a fragible tamper indicator including a frangibly mounted partition separating said first and second grooves and being enclosed by the opaque walls of said second groove.

5. A security seal according to claim 4 wherein said reversely bent end portions have a width greater than the width of said chamber plus the depth of said first groove.

* * * * *